United States Patent [19]

Hasenbalg

[11] 4,441,833

[45] Apr. 10, 1984

[54] KEYBOARD ACTUATOR

[76] Inventor: Ralph D. Hasenbalg, 8635 Rudnick Ave., Canoga Park, Calif. 91304

[21] Appl. No.: 310,850

[22] Filed: Oct. 13, 1981

[51] Int. Cl.[3] ..... B41J 23/22; F15B 15/26

[52] U.S. Cl. ..... 400/180; 92/24; 400/473

[58] Field of Search ..... 400/180, 181, 473, 474; 92/24, 27, 28

[56] References Cited

U.S. PATENT DOCUMENTS

| | | | |
|---|---|---|---|
| 859,843 | 7/1907 | Rogers | 92/24 |
| 1,772,892 | 8/1930 | Green | 92/24 |
| 2,130,618 | 9/1938 | Gnavi | 121/40 |
| 2,908,251 | 10/1959 | Gratzmuller | 92/27 X |
| 3,026,985 | 3/1962 | Oxley et al. | 400/180 |
| 3,033,171 | 5/1962 | Engelbrecht | 121/40 |
| 3,398,651 | 8/1968 | Folmer | 92/27 |
| 3,889,576 | 6/1975 | Sheffer | 91/394 |

FOREIGN PATENT DOCUMENTS

| | | | |
|---|---|---|---|
| 2144542 | 3/1973 | Fed. Rep. of Germany | 400/473 |

*Primary Examiner*—Paul T. Sewell

[57] ABSTRACT

A keyboard actuator for actuating the keys of a keyboard-operated apparatus including a plurality of fluid actuators supported by a frame, a first plurality of fluid conduits in communication with one or more selected fluid actuators, and first and second valve means for applying fluid pressure to selected ones of the first and second plurality of fluid conduits in response to signals from the control means. The fluid actuators include latching means and piston means. In response to fluid pressure, the latching means releases the piston means and the piston means may be driven to actuate a key of the keyboard-operated apparatus.

18 Claims, 7 Drawing Figures

KEYBOARD ACTUATOR

BACKGROUND OF THE INVENTION

The present invention relates generally to computer peripheral devices and more particularly to an actuator apparatus for actuating the keys of a keyboard in response to control signals which may be computer generated. Also disclosed is an improved latching fluid actuator device.

As the use of computers and microprocessors continues to increase, the types and configurations of keyboards associated therewith has also continued to expand. These keyboards include not only the well-known typewriter-like keyboard, but also keypads for numeric or control function input and special purpose keyboards as found in point-of-sale terminals.

With the increasing use of keyboards, there also arises a corresponding need to test the keyboards thoroughly. Although such tests can be done manually, testing of this nature can be time consuming and thus expensive. Moreover, manual testing presents the possibility that the person conducting the test may not accurately follow the test routine, resulting in keyboards that are not fully tested. Also, where the durability of a keyboard is to be tested by repeated actuation of the keys, manual testing is impractical because of the length of time required to complete such tests.

Therefore, there is a need for a keyboard actuator which can efficiently and effectively test various types of keyboards. It is further desirable that such an actuator be able to test a keyboard quickly and that the actuator be reliable and operable for long periods of time. Also, it is advantageous that such an actuator be relatively simple and mechanically sturdy to increase its reliability.

SUMMARY OF THE INVENTION

The keyboard actuator and fluid actuator of the present invention overcome the limitations and disadvantages described above, and provide a keyboard actuator that is both durable and reliable. The actuator is able to operate at relatively high speeds for sustained periods of time. The keyboard actuator is adjustable to accommodate various keyboard configurations.

The keyboard actuator disclosed herein includes a frame and a plurality of fluid actuators. The fluid actuators are supported by support members and are adapted to be associated with respective keys of a keyboard-operated apparatus. A first plurality of fluid conduits is in communication with one or more selected fluid actuators. Also, a second plurality of fluid conduits is in communication with one or more selected actuators, each of the fluid actuators being responsive to one of the first plurality of fluid conduits and one of the second plurality of fluid conduits. A control means provides signals to first valve means which apply fluid pressure to a selected one of the first plurality of conduits. A second valve means also responsive to the control means signals applies fluid pressure to a selected one of the second plurality of conduits. The fluid pressure in the selected ones of the first and second pluralities of fluid conduits causes latch means in a fluid actuator to unlatch and piston means in the fluid actuator to operate a key of the keyboard associated with the particular actuator.

Thus, by applying fluid pressure to one conduit of each of the first and second plurality of fluid conduits, one actuator is unlatched by fluid pressure and is powered by fluid pressure to actuate a corresponding keyboard key.

A latching fluid actuator in accordance with the present invention provides a latching function in an unexpectedly simple device which can be, for example, injection molded. The embodiment of the fluid actuator disclosed herein can include a piston having a rod and a latch element with a first member and a second member disposed on opposite sides of the piston rod. A third member of the latch element interconnects the first member and the second member. The piston rod includes engagement means such as a notch. A spring biases the first member of the latch element into engagement with the engagement means. A relatively simple fluid responsive member such as a diaphragm operates the second member of the latch element against the biasing force of the spring to unlatch the piston. The piston is then free to move under fluid pressure. In the embodiment disclosed herein, the piston is adapted to actuate a keyboard key.

Thus, the keyboard actuator and latching fluid actuator as disclosed herein provide a reliable means for actuating a keyboard. The keyboard actuator can operate a keyboard at high rates of keystrokes-per-second for extended periods of time. The keyboard actuator may be adjusted for various keyboard sizes and surface inclinations. The use of fluid actuation also eliminates tolerance buildup which may be apparent in mechanical systems employing a number of mechanical elements to effect actuation of keyboard key. The latching fluid actuator advantageously allows the keyboard actuator to be operated in response to fluid pressure, thus minimizing the number of moving or sliding components and elements to thereby decrease overall complexity and increase reliability. Furthermore, the fluid actuator, by including both latching means and piston means, performs a function similar to a logic AND, that is, the piston means does not move unless both drive fluid pressure and latch release fluid pressure are applied to the fluid actuator. This enables the fluid actuators to be arranged in the keyboard actuator as a matrix of rows and columns each controlled by a fluid valve. As such, a relatively few number of fluid valves can be used to control a larger number of fluid actuators, further decreasing the cost and complexity of the keyboard actuator apparatus.

It is thus an object of the present invention to provide an improved keyboard actuator.

It is another object of the present invention to provide a keyboard actuator which is operated by fluid pressure.

It is yet another object of the present invention to provide an improved latching fluid actuator.

IN THE DRAWINGS

These and other objects and advantages of the present invention are apparent from a consideration of the following detailed description and the drawings in which.

DETAILED DESCRIPTION

Figure 1:
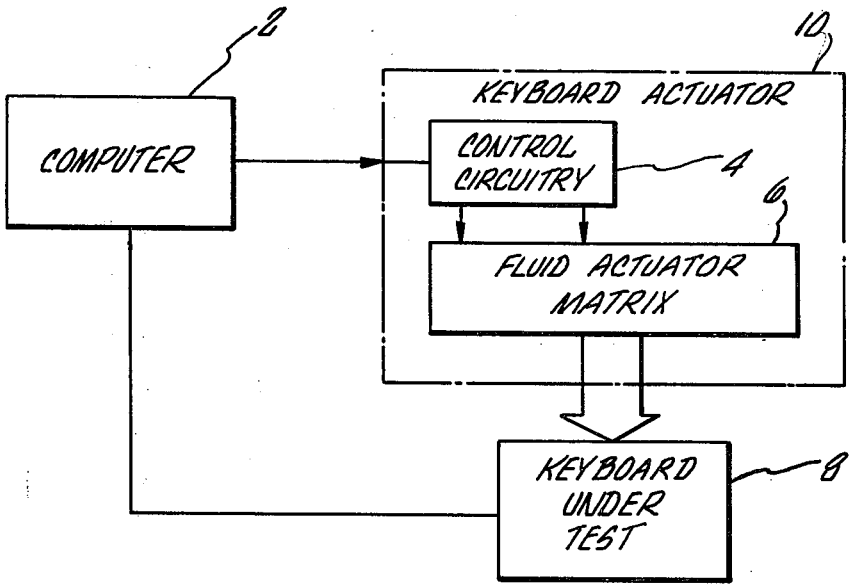
FIG. 1 is a block diagram of a system which can utilize a keyboard actuator in accordance with the present invention.

An overall system which may utilize a keyboard actuator in accordance with the present invention is shown in FIG. 1. A computer 2 provides coded signals to a keyboard actuator 10. Control circuitry 4 within the actuator 10 receives the coded signals and decodes the signals to operate a fluid actuator matrix 6. The matrix 6 in turn drives a keyboard under test 8 by actuating the keys thereof. An output from the keyboard under test 8 to the computer 2 provides an indication of keyboard performance which is used to detect errors in keyboard operation.

Figure 2:
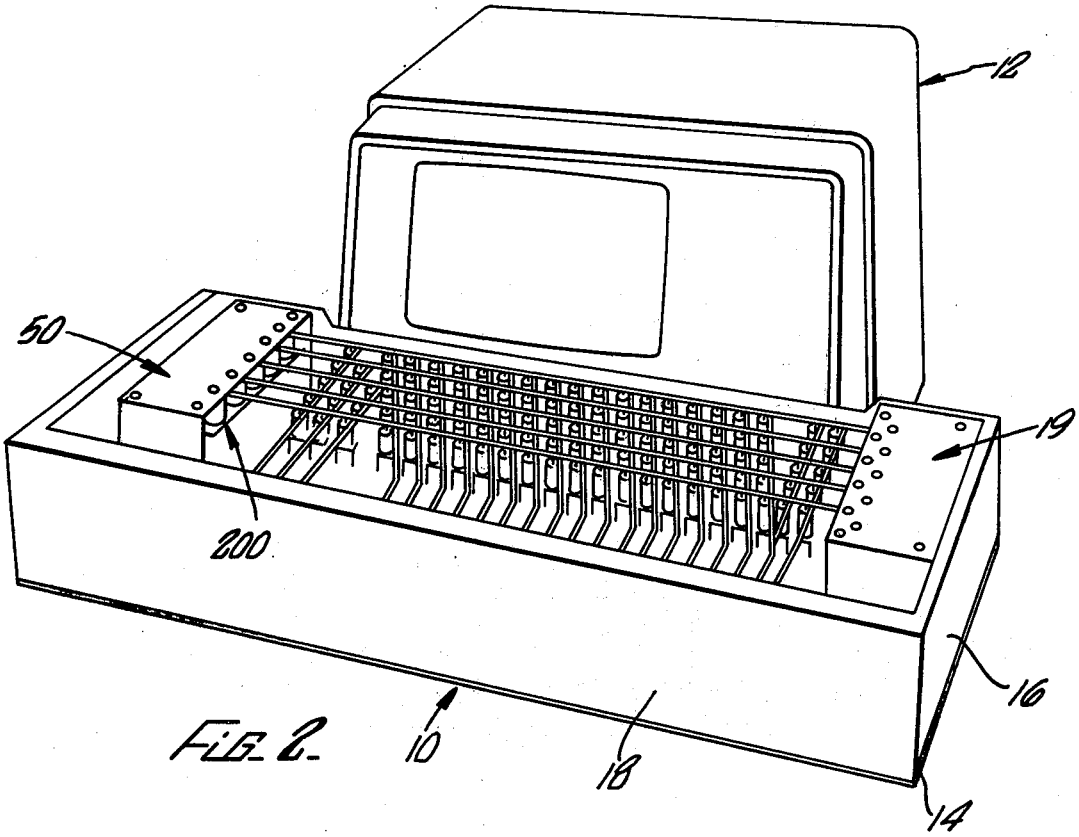
FIG. 2 is a perspective view of a keyboard actuator in accordance with the present invention.

With reference now to FIG. 2, the keyboard actuator 10 is adapted to be positioned over the keyboard under test (not shown) of, for example, a computer terminal 12. The keyboard actuator 10 has a bottom plate 14 to which are fixed three side panels, two of which are designated 16 and 18 in FIG. 2. The third side panel is opposite the panel 16. The keyboard actuator 10 is opened at the side opposite the side panel 18 to receive the keyboard of the terminal 12.

Figure 3:
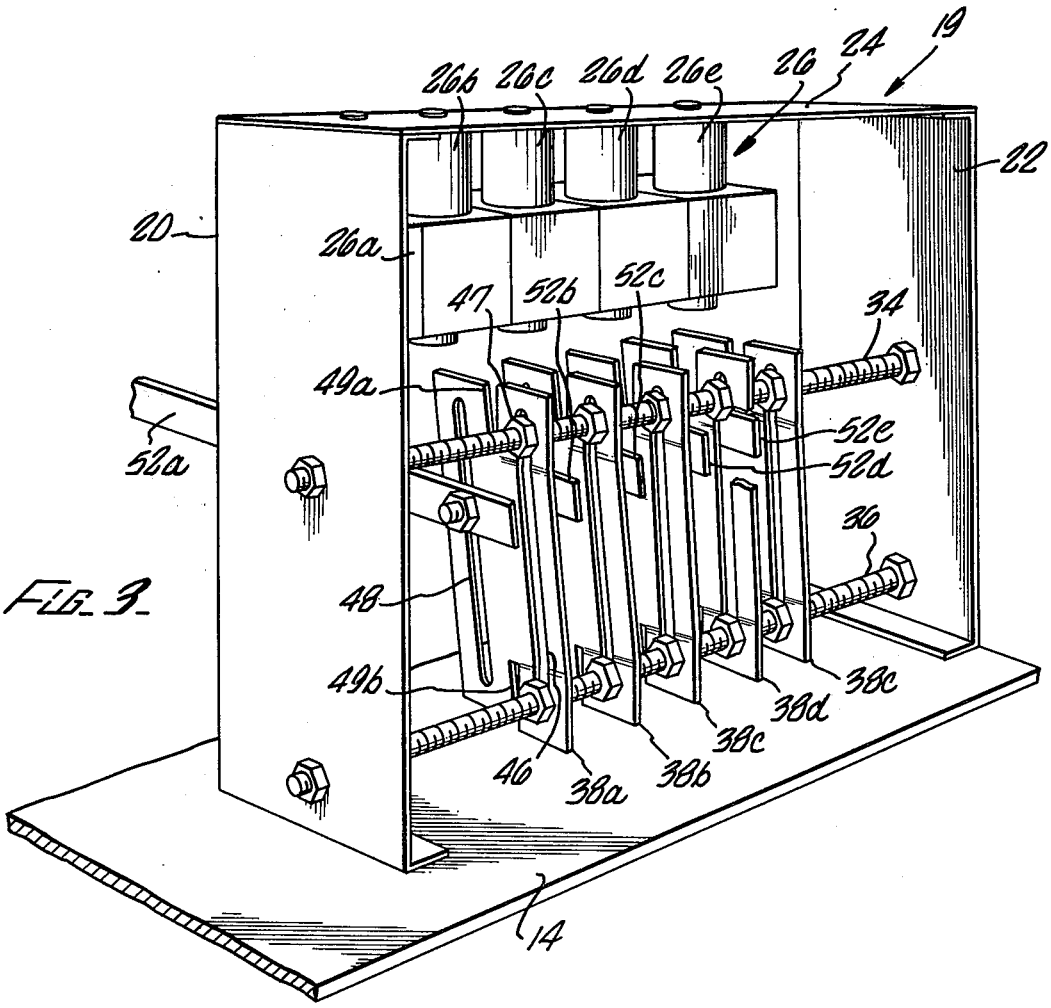
FIG. 3 is a cut away perspective view of adjustable mounting elements for latching fluid actuators within the keyboard actuator of FIG. 2.

As shown in FIG. 3 wherein side panel 16 has been removed, a fluid actuator support and adjustment mechanism 19 includes two support stanchions 20 and 22 that are fixed to the bottom plate 14. The stanchions 20 and 22 are parallel to each other and also parallel to the side panel 18. A solenoid support plate 24 is fixed to the top of the stanchions 20 and 22. A plurality of solenoid-operated fluid valves 26, individually designated 26*a*–26*e*, are supported by the support plate 24.

Two threaded rods 34 and 36 are fixed between the support stanchions 20 and 22. The upper threaded rod 34 is approximately midway between the bottom plate 14 and the solenoid support plate 24 while the lower threaded rod 36 is proximate the bottom plate 14. A plurality of actuator support plates 38*a*–38*e* are fixed to the threaded rods 34 and 36. Each of the actuator support plates 38*a*–38*e* includes an outer vertical elongated slot 46 and a similar inner vertical elongated slot 48. The upper and lower threaded rods 34 and 36 pass through the outer vertical elongated slots 46 of the actuator support plates 38*a*–38*e*.

The plates 38*a*–38*e* are secured to the threaded rods 34 and 36 by means of nuts 47 tightened on both sides of the plates 38*a*–38*e*. It is to be observed that by varying the location of the nuts 47 which secure the plates 38*a*–38*e* to the rods 34 and 36, the actuator support plates 38*a*–38*e* can be angled to match the angle of a keyboard. Also the position of the actuator support plates 38*a*–38*e* along the threaded rods 34 and 36 can be adjusted by the nuts 47 to adjust the spacing between the actuator support plates 38*a*–38*e* to correspond to the spacing between adjacent rows of keys on the keyboard to be tested.

Vertical notches 49*a* and 49*b* are formed at the upper and lower edges of the actuator support plates 38*a*–38*e* between the outer and inner vertical elongated slots 46 and 48. The vertical slots 49*a* and 49*b* allow the portion of the support plates 38*a*–38*e* fixed to the threaded rods 34 and 36 to be bent to be generally perpendicular to the threaded rods for a firm mechanical connection therebetween.

An actuator support and adjustment mechanism 50 similar to the mechanism 19 is disposed at the opposite end of the keyboard actuator 10. The adjustment mechanism 50 includes structure substantially similar to the elements just described with respect to the adjustment mechanism 19 in FIG. 3.

Fixed between the mechanisms 19 and 50 are actuator support bars 52*a*–52*e*, the support bars being adjustably fixed between corresponding actuator support plates 38*a*–38*e* in the mechanism 19 and support plates in the mechanism 50. In the embodiment of FIG. 3, the support bars 52*a*–52*e* are disposed generally vertically. The support bars 52*a*–52*e* are adjustably fixed to the inner vertical elongated slots 48 in the support plates 38*a*–38*e* and are similarly fixed to inner vertical elongated slots in the corresponding support plates of the adjustment mechanism 50. The support bars 52*a*–52*e* can thus be adjusted to a position along these elongated slots which correctly positions the support bars 52*a*–52*e* at a predetermined height above the keyboard.

By adjusting the support plates 38*a*–38*e* along the threaded rods 34 and 36 as described above, with respect both to angle and position, the support bars 52*a*–52*e* can be positioned over rows of keys in the keyboard to be tested and can be angled to conform to the slant of the keyboard. The slots 49*a* and 49*b* at the upper and lower portions of the actuator support plates 38*a*–38*e* surrounding the inner vertical elongated slots 48 isolate the upper and lower ends of the inner vertical elongated slots 48 from the outer slots 46. When the portions of the plates 38*a*–38*e* are bent generally perpendicular to the threaded rods 34 and 36 as described above, the portions of the plates 38*a*–38*e* surrounding the inner slots 48 remain at the angle of the plates 38*a*–38*e* set with respect to the threaded bars 34 and 36, consequently setting the angle of the support bars 52*a*–52*e*.

As thus described above, the mechanisms 19 and 50 allow complete adjustment of the support rods 52*a*–52*e* so as to be adapted to the particular physical configuration of a variety of keyboards. The adjustments can be easily performed and can be changed repeatedly without degrading the performance of the keyboard actuator 10.

Figure 4:
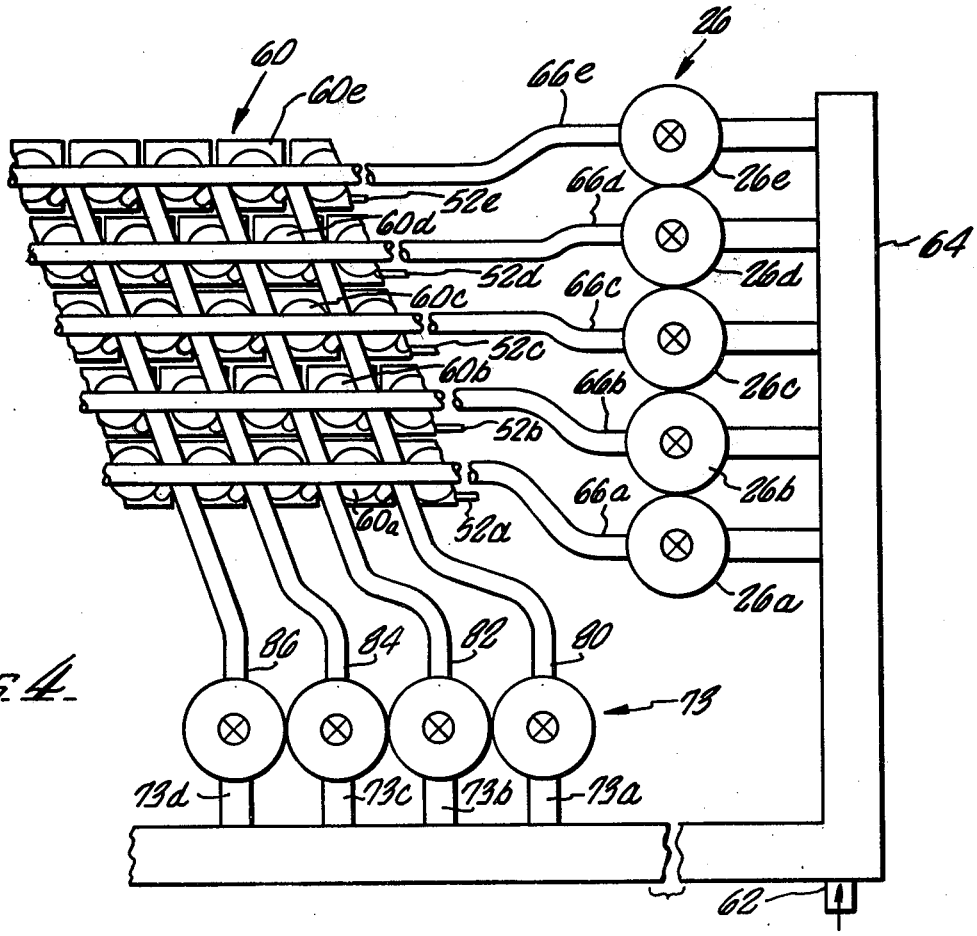
FIG. 4 is a partial schematic representation of the fluid conduits, latching fluid actuators and fluid valves in the keyboard actuator of FIG. 2.

Turning now to FIGS. 3 and 4, each of the actuator support bars 52*a*–52*e* supports a plurality of latching fluid actuators designated generally 60. The actuators 60 are arranged in rows along the corresponding support bars 52*a*–52*e*. The spacing between adjacent ones of the actuators 60 is adjusted to conform to the spacing between the keys of the keyboard over which the keyboard actuator 10 is adapted to be placed.

As best seen schematically in FIG. 4, a fluid inlet 62 provides fluid under pressure to a supply manifold 64. The supply manifold 64 is in turn in communication with the solenoid-operated fluid valves 26*a*–26*e*. A plurality of fluid conduits or manifolds 66*a*–66*e* are connected to the outputs of the valves 26*a*–26*e* respectively.

The manifold 66*a* is connected to a drive fluid inlet of each of the actuators 60 fixed to the actuator support bar 52*a*. Similarly, the fluid manifolds 66*b*–66*e* are connected to drive fluid inlets on the actuators 60 fixed to the actuator support bars 52*b*–52*e*, respectively. In this way, the conduits 66*a*–66*e* provide drive fluid pressure to respective rows of actuators 60 fixed on the actuator support bars 52*a*–52*e*.

A second plurality of solenoid-operated fluid valves 73 are connected to the supply manifold 64, four of these valves being designated 73*a*–73*d* in FIG. 2. These valves, which may be fixed to the bottom plate 14, each have outputs connected to one of a plurality of fluid conduits or manifolds 79, four of which are designated 80–86 in FIG. 4. Each of these conduits 79 supplies a latch release fluid inlet on five generally adjacent actuators 60 which can be considered as forming a column of actuators 60 on the actuator support bars 52*a*–52*e*. For example, the manifold 80 supplies the latch release fluid inlets on adjacent actuators 60*a*, 60*b*, 60*c*, 60*d* and 60*e*.

By way of brief summary, the fluid valves 26 can be considered as supplying fluid pressure to individual rows of actuators 60 while the plurality of valves 73 can be considered as supplying selected columns of the actuators 60. Thus, the valves 26 and 73 define an X-Y coordinate system or matrix, the valves 26 controlling the row of X coordinate with the valves 73 defining the column or Y coordinate of the system. The operation of the fluid valves is described further herein below.

Figure 7:
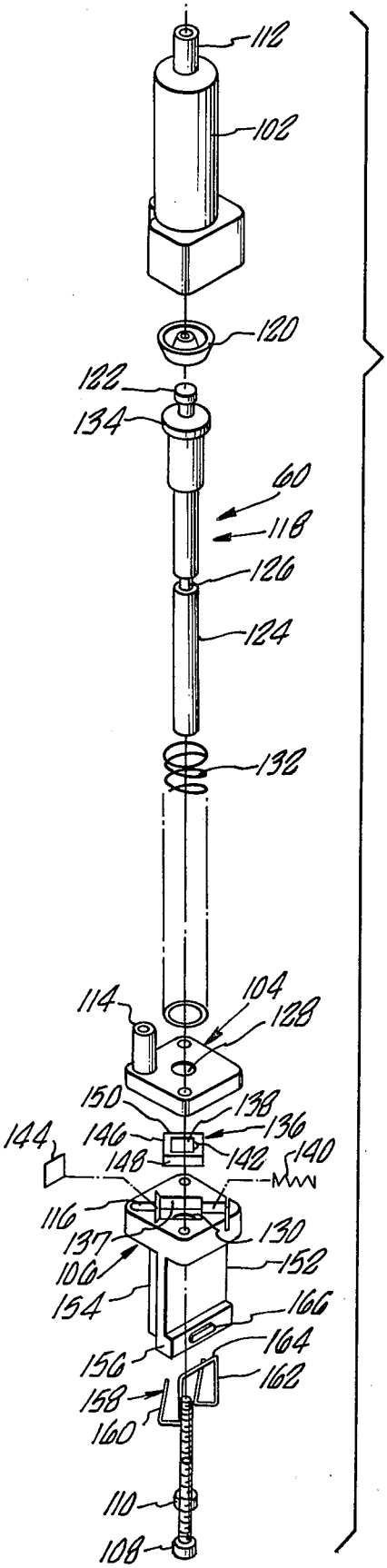
FIG. 7 is an exploded view of the latching fluid actuator of FIGS. 5 and 6.
Figure 5:
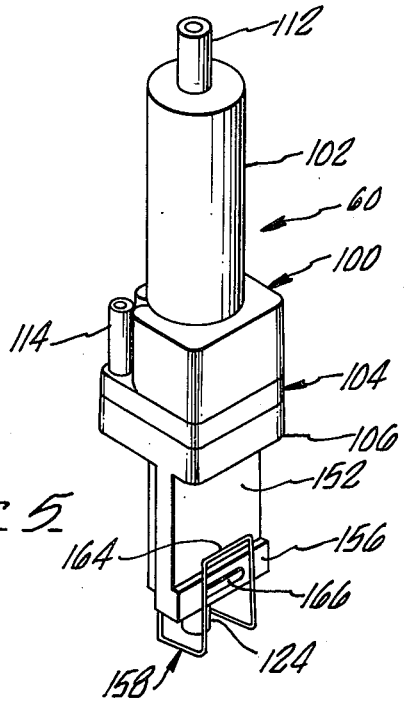
FIG. 5 is an exterior view of a latching fluid actuator used in the keyboard actuator of FIG. 2.
Figure 6:
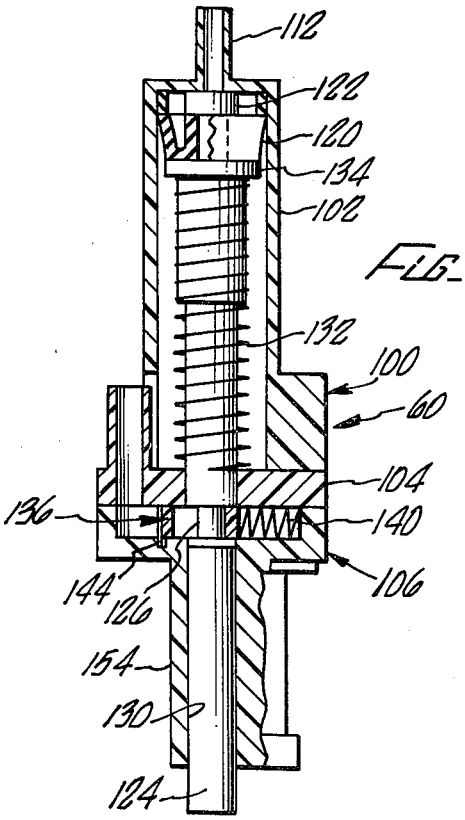
FIG. 6 is a cut away view of the latching fluid actuator of FIG. 5.

Turning now to FIGS. 5–7, the latching fluid actuator 60 includes a housing 100 comprising a cylinder 102, a latch cover 104 and a base 106. Two self-tapping screws 108 and 110 hold the housing components together to form a completed actuator 60.

The cylinder 102 includes a drive fluid inlet 112 at the upper end thereof and the latch cover 104 includes a latch release fluid inlet 114. The drive fluid inlet 112 allows fluid communication into the cylinder 102 while the latch release fluid inlet 114 provides fluid communication through the latch cover 104 to a small chamber 116 in the base 106.

A piston 118 is carried within the cylinder 102. A U-cup seal 120 is fixed to a pin 122 at the top of the piston 118. The seal 120 provides a seal between the piston 118 and the inside surface of the cylinder 102. A piston rod 124 extends downwardly and includes an engagement means comprising a latch notch 126. As seen in FIGS. 5–7, the rod 124 extends through an opening 128 in the cover 104 and a second opening 130 in the actuator base 106. A piston return spring 132 is carried by the piston rod 124 between the cover 104 and a flange 134 at the upper end of the piston. The spring 132 biases the piston 118 upwardly as seen in FIGS. 5–7.

An unexpectedly simple latch release means is carried between the cover 104 and the base 106. This latch release means includes a latch member 136 carried in a cavity 137. The latch member has an opening 138 through which is passed the rod 124. A latch return spring 140 acting against a first member 142 biases the latch element 136 toward the rod 124. A latch diaphragm 144 is carried in slots formed into the latch cover 104 and the base 106. One side of the diaphragm 144 is in communication with the chamber 116. The second side of the diaphragm 144 acts against a second member 146 of the latch element 136. Two side members 148 and 150 of the latch element 136 connect the first member 142 to the second member 146 and define the opening 138.

A flat mounting tongue 152 extends downwardly from the base 106. The tongue 152 includes a guide 154 for the piston rod 124. A lip 156 projects from the lower edge of the mounting tongue 152. A resilient clip 158 of bent spring wire is adapted to fit over the lip 156 and tongue 152. The clip 158 includes two generally U-shaped spring portions 160 and 162 and a joining member 164 which connects the portions 160 and 162 such that the portions 160 and 162 are parallel.

The mounting tongue 152 is adapted to receive one of the actuator support bars 52*a*–52*e* (FIGS. 2–4). The bar is received against the mounting tongue 152 between the base 106 and the lip 156. The clip 158 is initially installed onto the lip 156 such that the joining member 164 is above a projection 166 on the lip 156 to thereby retain the clip 158. Once the actuator 60 is installed on one of the support bars 52*a*–52*e*, the clip 158 is then moved upwardly to secure the actuator 60 to the support bar. This results in a simple, inexpensive and reliable mounting means for the actuator 60.

The operation of the latching fluid actuator 60 (FIGS. 5–7) will first be considered. With no fluid pressure applied to the actuator 60, the spring 132 returns the piston 118 upwardly into the cylinder 102. Once the notch 126 is aligned with the first member 142 of the latch element 136, the spring 140 urges the first member 142 into engagement with the notch 126. This latches the piston 118 in a retracted position. Fluid pressure may then be applied to the drive fluid inlet 112 but the piston 118 will not be displaced in response thereto.

However, with fluid pressure applied to the latch release fluid inlet 114, the latch diaphragm 144 drives the latch element 136 against the bias of the spring 140 to thereby unlatch the piston 118. The movement of the latch element 136 is restricted by the dimensioning of the cavity 137 which carries the latch element 136. With the piston 118 released, fluid pressure applied through the drive fluid inlet 112 can move the piston 118 downwardly against the force of the spring 132, thereby extending the rod 124.

It is to be noted that fluid pressure applied to only one of the inlets, that is either the drive fluid inlet 112 or the latch release fluid inlet 114, does not cause displacement of the piston 118. Instead, fluid pressure must be applied to both of the inlets 112 and 114 in order to enable the movement of the piston 118. Moreover, it will be recognized that the fluid actuator 60 can be modified such that the latching of the piston will only be accomplished when fluid pressure is applied to the diaphragm 144. To accomplish this, the spring 140 is arranged to bias the latch element 136 into the unlatched position, that is, the first member 142 is not engaged with the notch 126. The diaphragm 144 is then arranged to act against the first member 142 so that when fluid pressure is applied to the diaphragm 142, the piston 118 will be latched when the first member 142 is aligned with and thus engages the notch 126. Also, the fluid actuator 60 can be adapted to latch the piston 118 is various positions, such as extended or down, by changing the location of the notch 126 along the piston rod 124.

Suitable electronic control circuitry 4 is used to actuate selected ones of the valves 26 and the valves 73. The type of control circuitry used is not critical and may be similar, for example, to the system disclosed in U.S. Pat. No. 4,146,336 issued to the applicant herein, the disclosure of which is incorporated herein by reference. Particularly, FIG. 4 of U.S. Pat. No. 4,146,336 discloses circuitry which in substantial part may be used to drive the valves 26 and 73. It is to be noted that the "power solenoid" and the "Y latch solenoid" disclosed in FIG. 4 of the referenced patent would correspond to the solenoid controlled valves 26 and 73, respectively, as would be apparent to one of ordinary skill in the art. It is desirable that fluid pressure be applied to the latch release fluid inlet of the actuators 60 by one of the valves 73 slightly before the fluid pressure is applied by one of the valves 26 to the drive fluid inlets of the actuators 60. This allows the latch element 136 to be released before drive fluid pressure is applied to the piston 118.

It will also be apparent to those skilled in the art that the keyboard actuator 10 of the present invention may be controlled by microprocessor-based circuitry. The microprocessor advantageously can be reprogrammed to vary functions and to redefine the operation of the keyboard actuator 10.

The overall operation of the keyboard actuator 10 may now be summarized. With reference to FIGS. 1, 4 and 6, the computer 2 provides to the control circuitry of the keyboard actuator 10 signals such as an ASCII code. The control circuitry in turn decodes the input and controls one of the solenoid valves 26 and one of the solenoid valves 73 to apply fluid pressure from the supply manifold 62 to the manifolds associated with the respective valves. One of the latching fluid actuators 60 thus receives both latch release fluid pressure and drive fluid pressure. Consequently, the latch element 136 of the selected fluid actuator 60 releases the piston 118 and the piston 118 is driven downwardly. The piston rod 124 can then contact a keyboard key to actuate the key.

As a specific example, the computer 2 may provide an ASCII code to the control circuitry 4 corresponding to a letter "g". The control circuitry 4 may then actuate the valves **26*b* and 73*a*, applying fluid pressure to the manifolds 66*b* and 80. As noted previously, preferrably the valve 73*a* is operated slightly before the valve 26*b*. The pressure in the manifold 80 is applied to all the fluid actuators 60*a* through 60*e* while the pressure in the manifold 66*b* is applied to all of the actuators 60 fixed to the actuator support bar 52*b*. However, only one of the fluid actuators 60*a*–60*e* receives both latch release fluid pressure and drive fluid pressure, that actuator being fluid actuator 60*b*. Consequently, the piston 118 in the actuator 60*b* is driven to depress the key associated therewith. By properly adjusting the positions of the actuators 60**, this key is the "g" key of the keyboard being tested.

Once the key is actuated, the control circuitry 4 removes the control signals from the solenoid valves, such as the valves **26*b* and 73*a* described above. The valves remove fluid pressure from the associated manifolds 66*b* and 80 and vent these manifolds to atmosphere to completely release all fluid pressure applied to the associated actuator 60*b*. The return spring 132 in the actuator then drives the piston 118 upwardly until the latch element 136 engages the notch 126 to thereby latch the actuator, which in the example above is actuator 60*b***. In this way, a key actuation cycle is completed.

In the embodiment disclosed herein, solenoid valves 200 (FIG. 2) similar to the valves 26 are also provided at the second end of the manifolds **66*a*–66*e*, these valves being supported by the actuator support and adjustment mechanism 50. By providing two solenoid valves to the manifolds 66*a*–66*e*, decreased response time of the fluid actuators 60** is achieved while maintaining the overall fluid pressure in the system at a relatively low level. For example, the fluid may be pressurized air at approximately 10 to 30 lbs. per square inch gage.

Having thus described one embodiment of the present invention, it will be understood by those skilled in the art that various alternatives and equivalents are possible using the teachings herein. The scope of the present invention is not to be limited by the present disclosure but is to be determined by the scope of the appended claims.

I claim:

1. An actuator apparatus for controllably actuating selected keys of a keyboard-operated apparatus in response to signals from control means, the actuator apparatus comprising a frame, a plurality of fluid actuators adapted to be associated with respective keys of the keyboard-operated apparatus, each of the plurality of fluid actuators including piston means, support means for supporting the plurality of fluid actuators from the frame and with respect to the keys, a first plurality of fluid conduits, each one of the first plurality of fluid conduits being in fluid communication with one or more selected fluid actuators, a second plurality of fluid conduits, each one of the second plurality of fluid conduits being in fluid communication with one or more selected fluid actuators, first valve means for applying a fluid pressure from a fluid pressure source to a selected one of the first plurality of conduits selected in response to the control means signal, and second valve means for applying a fluid pressure from a fluid pressure source to a selected one of the second plurality of conduits selected in response to the control means signals, each of the plurality of fluid actuators being responsive to a specific set of selected ones of the first plurality of fluid conduits and selected ones of the second plurality of fluid conduits to drive the piston means thereof to thereby actuate the selected key associated therewith.

2. The actuator apparatus as in claim 1 wherein each of the plurality of fluid actuators includes latch means, the latch means releasing the piston means in response to fluid pressure in the respective one of the first plurality of conduits in communication therewith and the piston means, when released by the latch means, being driven in response to fluid pressure in the respective one of the second plurality of conduits in communication therewith to thereby actuate the key associated with the fluid actuator.

3. An actuator apparatus as in claim 2 wherein the piston means includes a cylinder closed at one end and a piston member sealably carried within the cylinder and including a piston rod, the latch means includes a latch element having a first member and a second member disposed on opposite sides of the piston rod and a third member interconnecting the first member and the second member, fluid inlet means for providing fluid communication from the respective one of the second plurality of fluid conduits through the cylinder closed end, spring means biasing the latch element to engagement with the piston member, the piston member including engagement means for receiving the latch to prevent piston member displacement, and a fluid responsive member acting against the latch element and responsive to the fluid pressure in the respective one of the first plurality of conduits in communication with the fluid actuator for operating the latch element to disengage the latch from the engagement means.

4. An actuator apparatus as in claim 3 wherein the engagement means comprises an indentation in the piston rod adapted to receive the second member to prevent piston member displacement.

5. An actuator apparatus as in claim 1 wherein the fluid actuators are arranged in a matrix having rows and columns and the first plurality of conduits individually are in communication with respective ones of the rows and the second plurality of conduits individually are in communication with respective ones of the columns.

6. An actuator apparatus for controllably actuating the keys of a keyboard-operated apparatus in response to signals from control means, the actuator apparatus comprising a frame, a plurality of fluid actuators adapted to be associated with respective keys of the apparatus, the fluid actuators being arranged in a matrix having rows and columns, support means for supporting the plurality of fluid actuators from the frame and with respect to the keys, a first plurality of fluid conduits in fluid communication with respective ones of the rows, a second plurality of fluid conduits in fluid communication with respective ones of the columns, first valve means for applying fluid pressure from a fluid pressure source to a selected one of the first plurality of conduits selected in response to the control means signals, second valve means for applying fluid pressure from the fluid pressure source to a selected one of the second plurality of conduits selected in response to the control means signals, and each of the plurality of fluid actuators including a latch element and piston means, the piston means including a cylinder closed at one end and a piston member sealably carried within the cylinder and including a piston rod, fluid inlet means for providing fluid communication from the respective one of the second plurality of fluid conduits through the cylinder closed end, the latch element having a first member and a second member disposed on opposite sides of the piston rod and a third member interconnecting the first member and the second member, spring means biasing the latch element into engagement with the piston member, the piston member including engagement means for receiving the second member to prevent piston member displacement, and a fluid responsive element acting against the first member and responsive to fluid pressure in the respective one of the first plurality of conduits in communication with the fluid actuator for operating the latch element to disengage the second member from the engagement means.

7. An apparatus as in claim 6 wherein the frame includes a base plate and the support means includes two support stanchions fixed to the base plate and extending therefrom, at least one rod fixed to and extending between the support stanchions, a plurality of support plates disposed between the support stanchions and adjustably fixed to the rod to thereby adjust the support plates spacings and angles with respect to the support stanchions, and a plurality of actuator support bars fixed to the support plates, the support bars receiving and supporting the fluid actuators.

8. An apparatus as in claim 7 wherein the support plates include an elongated slot and the actuator support bars are fixed to the support plates by fastener means through the slots to provide adjustment of the actuator support bars.

9. An actuator apparatus for controllably actuating the keys of a keyboard-operated apparatus in response to signals from control means, the actuator apparatus comprising a frame, a plurality of fluid actuators adapted to be associated with respective keys of the apparatus, the fluid actuators being arranged in a matrix of rows and columns, each of the plurality of fluid actuators including a latch element and piston means, the piston means including a cylinder closed at one end and a piston member sealably carried within the cylinder and including a piston rod, first fluid inlet means for providing fluid communication through the cylinder closed end, the latch element having a first member and a second member disposed on opposite sides of the piston rod and a third member interconnecting the first member and the second member, spring means biasing the latch element into engagement with the piston member, the piston member including an indentation in the piston rod adapted to receive the second member to prevent piston displacement, a fluid responsive diaphragm acting against the first member and responsive to fluid pressure applied to a second fluid inlet means for operating the latch element to disengage the second member from the indentation, and piston member return spring means for returning the piston member toward the closed end of the cylinder, support means for supporting the plurality of fluid actuators from the frame and with respect to the keys, a first plurality of fluid conduits in fluid communication with the first fluid inlet means of the fluid actuators in respective ones of the rows.

a second plurality of fluid conduits in fluid communication with the second fluid inlet of the fluid actuators in respective ones of the columns, first valve means for applying fluid pressure from a fluid pressure source to a selected one of the first plurality of conduits selected in response to the control means signals, and second valve means for applying fluid pressure from the fluid pressure source to a selected one of the second plurality of conduits selected in response to the control means signals.

10. A method for controllably actuating selected keys of a keyboard-operated apparatus in response to signals from control means comprising the steps of supporting a plurality of latching fluid actuators adapted to be associated with respective keys of a keyboard-operated apparatus, communicating a first fluid pressure from a first in response to the control means signals to release latch means within the selected latching fluid actuators, and communicating a second fluid pressure from a second valve means independent of the first valve means to one or more selected latching fluid actuators in response to the control means signals to provide drive fluid pressure to piston means within the selected latching fluid actuators, whereby each latching fluid actuator associated with each selected key selectively receives both the first fluid pressure from the first valve means and the second fluid pressure from the second valve means to unlatch the piston means and to drive the piston means to actuate the selected key of the keyboard with which it is associated.

11. A method as in claim 10 wherein the plurality of latching fluid actuators are disposed in a matrix of rows and columns and the step of communicating the first fluid pressure includes communicating the first fluid pressure to a selected row of the latching fluid actuators and the step of communicating the second fluid pressure includes communicating the second fluid pressure to a selected column of the latching fluid actuators.

12. A latching fluid actuator comprising a cylinder closed at one end and a piston member sealably carried within the cylinder, the piston member including a piston rod and engagement means, first fluid inlet means for providing fluid communication through the cylinder closed end, a latch element having a first member and a second member disposed on opposite sides of the piston rod and a third member interconnecting the first and second members, a fluid responsive diaphragm member acting against one of the first or second members of the latch element, second fluid inlet means for providing fluid communication to the fluid responsive member said second fluid inlet means providing a fluid communication independent of the fluid communication to the first fluid inlet means, and spring means for applying biasing force against the other of the first or second members of the latch element, the second member being adapted to engage the piston member engagement means, the engagement means being for receiving the second member to prevent piston member displacement.

13. An actuator as in claim 12 wherein the latch element includes an opening defined by the first member, second member and third member, the opening receiving the piston rod.

14. An actuator as in claim 12 or 13 including piston member return spring means for returning the piston member toward the closed end of the cylinder.

15. A latching fluid actuator comprising a cylinder closed at one end and a piston member sealably carried within the cylinder, the piston member including a piston rod and engagement means, first fluid inlet means for providing fluid communication through the cylinder closed end, a latch element having a first member and a second member disposed on opposite sides of the piston rod and a third member interconnecting the first and second members, a fluid responsive diaphragm acting against the first member of the latch element, second fluid inlet for providing fluid communication to the fluid responsive diaphragm said second fluid inlet means providing a fluid communication to the diaphragm independent of the first fluid inlet means, spring means biasing the latch element into engagement with the piston engagement means, the engagement means being for receiving the second member to prevent piston member displacement, and piston member return spring means for returning the piston member toward the closed end of the cylinder.

16. A method for controllably actuating selected keys of a keyboard-operated apparatus in response to signals from control means comprising the steps of supporting a plurality of latching fluid actuators adapted to be associated with respective keys of a keyboard-operated apparatus, communicating a first fluid pressure to one or more selected latching fluid actuators in response to the control means signals to release latch means within the selected latching fluid actuators, and communicating a second fluid pressure to one or more selected latching fluid actuators in response to the control means signals to provide drive fluid pressure to piston means within the selected latching fluid actuators, whereby each latching fluid actuator associated with each selected key selectively receives both the first fluid pressure and the second fluid pressure to unlatch the piston means and to drive the piston means to actuate the selected key of the keyboard with which it is associated, the plurality of latching fluid actuators being disposed in a matrix of rows and columns and the step of communicating the first fluid pressure to a selected row of the latching fluid actuators and the step of communicating the second fluid pressure includes communicating the second fluid pressure to a selected column of the latching fluid actuators.

17. A latching fluid actuator comprising a cylinder closed at one end and a piston member sealably carried within the cylinder, the piston member including a piston rod and engagement means, first fluid inlet means for providing fluid communication through the cylinder closed end, a latch element having a first member and a second member disposed on opposite sides of the piston rod and a third member interconnecting the first and second members, a fluid responsive diaphragm member acting against one of the first or second members of the latch element, second fluid inlet means for providing fluid communication to the fluid responsive member, said second fluid inlet means providing a fluid communication independent of the fluid communication to the first fluid inlet means, and spring means for applying biasing force against the other of the first or second members of the latch element, the second member being adapted to engage the piston member engagement means, the engagement means being for receiving the second member to prevent piston member displacement when said piston member is in a retractive position within the cylinder.

18. An actuator as claimed in any one of claims 12, 15, or 17 wherein the latching element and diaphragm are integrally contained at the end of the cylinder remote from the closed end.

* * * * *